US005207308A

United States Patent [19]

Sheffield et al.

[11] Patent Number: 5,207,308

[45] Date of Patent: May 4, 1993

[54] MOVING HANDRAIL DRIVE BELT TENSIONING DEVICE

[75] Inventors: George E. Sheffield, Cooper City; Albert E. Moniz, Miami, both of Fla.

[73] Assignee: Otis Elevator Company, Farmington, Conn.

[21] Appl. No.: 885,325

[22] Filed: May 18, 1992

[51] Int. Cl.[5] ..... B66B 23/16

[52] U.S. Cl. ..... 198/336

[58] Field of Search ..... 198/335, 336

[56] References Cited

U.S. PATENT DOCUMENTS 3,749,224 7/1973 Engeler ..... 198/336 X 5,117,960 6/1992 Ahls et al. ..... 198/335

FOREIGN PATENT DOCUMENTS 1934210 1/1971 Fed. Rep. of Germany ..... 198/336

1393745 5/1988 U.S.S.R. ..... 198/335

1481182 5/1989 U.S.S.R. ..... 198/335

*Primary Examiner*—D. Glenn Dayoan

*Attorney, Agent, or Firm*—William W. Jones

[57] ABSTRACT

A spring loaded tensioning assembly is mounted on the truss of a moving walkway or escalator to apply pressure and tension to a moving handrail drive belt. The assembly includes a roller which is biased against the inside surface of the drive belt to urge the drive belt against the inside surface of the handrail. The tensioning assembly is an adjunct to the original equipment drive belt tensioner and can be retrofitted onto existing equipment in the field to extend the service life of the drive belt.

8 Claims, 2 Drawing Sheets

MOVING HANDRAIL DRIVE BELT TENSIONING DEVICE

DESCRIPTION

1. Technical Field

This invention relates to a moving handrail drive belt tensioner, and more particularly to an auxiliary drive belt tensioner which can be retrofitted onto existing equipment in the field.

2. Background Art

The moving handrail of an escalator or moving walkway is driven by a drive belt that engages the inside surface of the handrail and frictionally applies a driving force to the handrail. The handrail is forced by the drive belt against a support roller bow which provides the backup force for the drive belt. The drive assembly is mounted on the people mover truss along the return path of travel of the handrail. The drive belt is reeved over a drive roller and a tension roller, the latter of which is spring-biased so as to stretch the belt thereby applying a constant tension thereto. One drawback which has arisen with the aforesaid drive system is excessive drive belt wear, which requires frequent replacement of the drive belts.

DISCLOSURE OF THE INVENTION

This invention relates to a drive belt tensioning assembly which can be retrofitted onto an existing escalator or moving walkway in the field, and which lessens the problem of drive belt wear encountered in the prior art system. The belt tensioning assembly of this invention applies a tensioning pressure directly to the drive belt from the inside of the drive belt loop. The drive belt is thus forced against the handrail after the handrail has encountered the support roller bow. The tensioning assembly of this invention includes a mounting bracket which can be secured to the people mover truss by two bolts which are already disposed on the truss. A threaded rod is secured to a yoke or fork in which a pressure roller is journaled. The threaded rod is slidably mounted on the bracket, and is spring loaded against a stop surface on the bracket so as to spring load the pressure roller against the inside surface of the drive belt along the arc of the support roller bow. The outer surface of the presser roller has circumferential grooves which match ribs found on the inner surface of the drive belt.

It is therefore an object of this invention to provide a moving handrail drive belt tensioner that can apply a pressing force on the drive belt which presses the drive belt against the handrail.

It is another object of this invention to provide a drive belt tensioner of the character described which presses against the inner side of the drive belt loop to force the drive belt against the handrail.

It is a further object of this invention to provide a drive belt tensioner of the character described which can be retrofitted onto an existing escalator or moving walkway in the field.

It is an additional object of this invention to provide a drive belt tensioner of the character described which utilizes a spring force to press the tensioner against the drive belt.

These and other objects and advantages of the invention will become more readily apparent from the following detailed description of a preferred embodiment thereof when taken in conjunction with the accompanying drawings, in which:

BEST MODE FOR CARRYING OUT THE INVENTION

Figure 1:
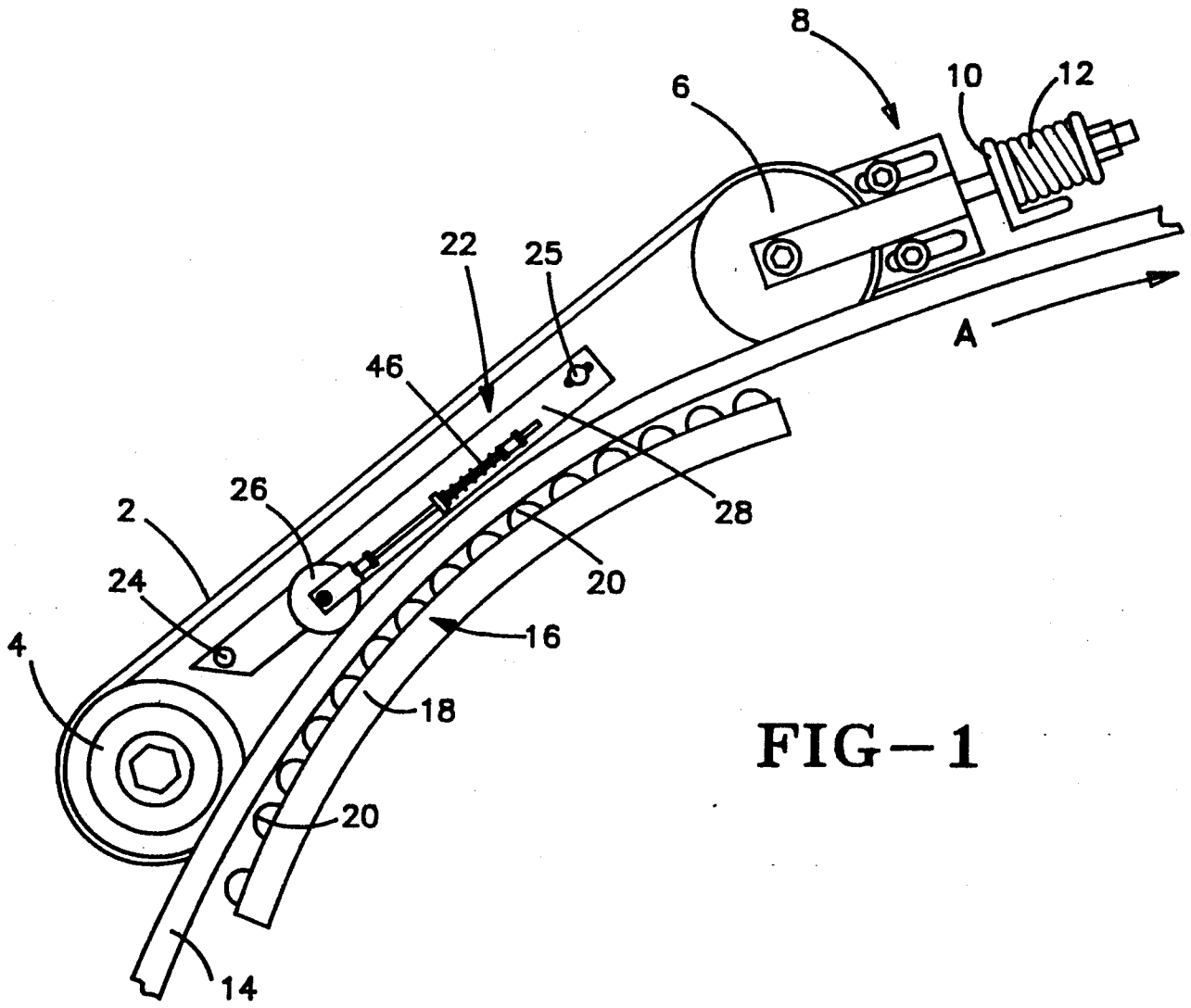
FIG. 1 is a fragmented side elevational view of a handrail drive belt assembly of the prior art into which the tensioner assembly of this invention has been incorporated.

Referring now to the drawings, FIG. 1 shows a handrail drive assembly which includes a drive belt 2 reeved about a powered roller 4 and a tensioning roller 6. The powered roller 4 will typically be driven by the main step drive sprocket (not shown) in the escalator or moving walkway. The tensioning roller 6 is journaled on a tension carriage 8 mounted on the people mover truss 10 and biased in a drive belt-stretching direction by a spring 12. The drive belt 2 contacts the inner surface of the handrail 14 as the latter moves along an arcuate path of travel defined by a support roller bow assembly 16. The roller bow assembly 16 includes a curved elongated bracket 18 which is secured to the truss, and on which are journaled a plurality of support or backup rollers 20 which contact the outer or exposed surface of the handrail 14. The inner surface of the drive belt 2 which contacts the rollers 4 and 6 is ribbed so as to increase friction between the powered roller 4 and the drive belt 2.

The tensioning device of this invention is denoted generally by the numeral 22, and is mounted on two existing bolts 24 and 25 located on the truss inside of the loop of the drive belt 2. The tensioner 22 includes a pressure roller 26 which is movably mounted on a bracket 28. In the embodiment shown in FIG. 1, the handrail 14 moves in the direction of the arrow A, and the pressure roller 26 is located to the handrail entry side of the roller bow 16.

Figure 2:
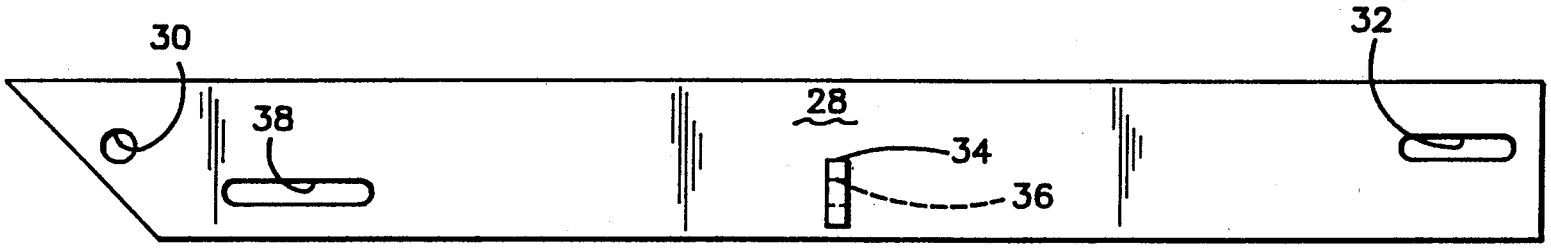
FIG. 2 is a side elevational view of the tensioner assembly bracket.
Figure 3:
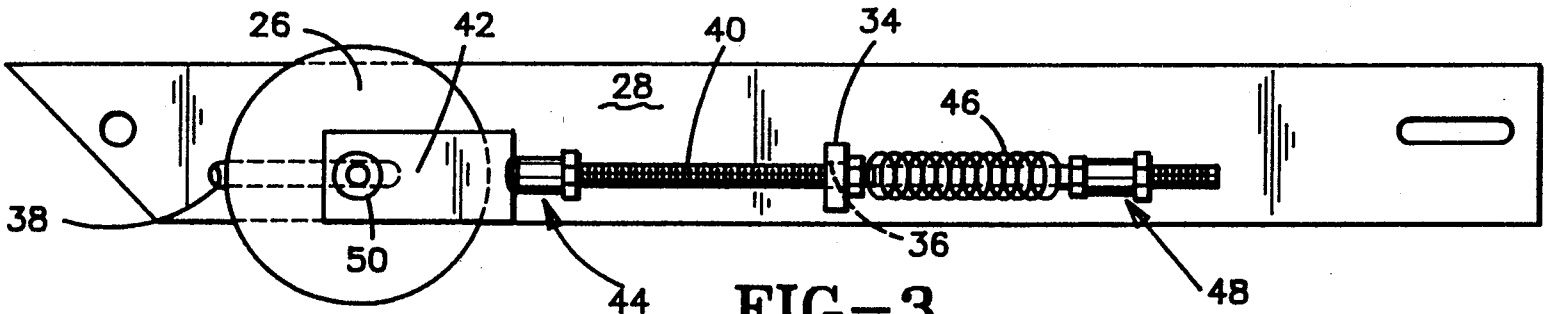
FIG. 3 is a view similar to FIG. 2 but showing the pressure roller mounted on the bracket.
Figure 4:
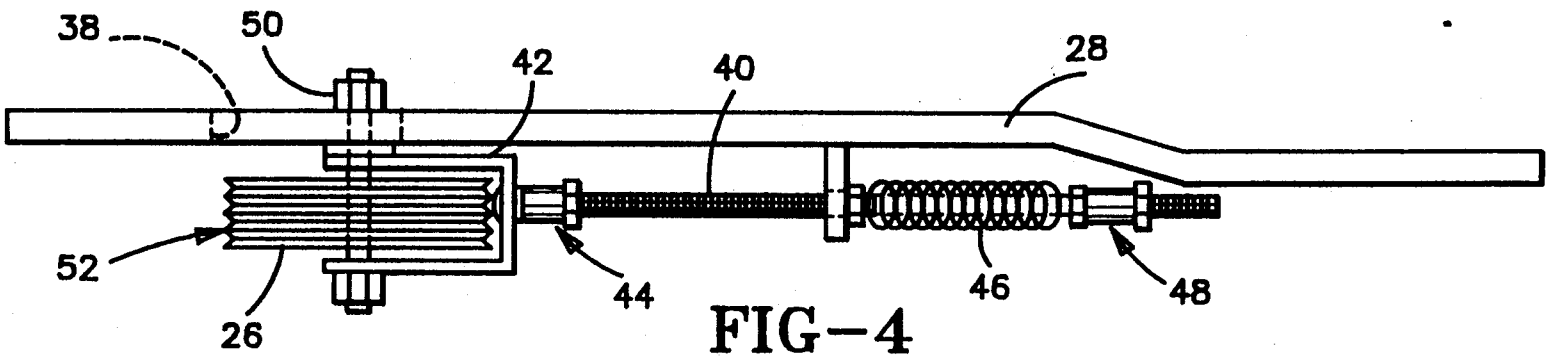
FIG. 4 is a top view of the tensioner assembly of FIG. 3.

FIGS. 2—4 show details of the tension device 22. As noted in FIG. 2, the bracket 28 has a hole 30 at one end for receiving the truss bolt 24, and an elongated slot 32 at the other end for receiving the truss bolt 25. The slot 32 allows some flexibility as to the exact locations of the bolts 24 and 25. A guide 34 having a through passage 36 projects from the side of the bracket 28, and an elongated slot 38 is formed to one side of the ear 34 in general alignment with the passage 36. As seen in FIGS. 3 and 4, a threaded rod 40 carries a yoke 42 at one end thereof, and extends through the ear passage 36. A nut assembly 44 threaded onto the rod 40 secures the yoke 42 in place, and a coil spring 46 seats against the ear 34 and against a second nut assembly 48 threaded onto the rod 40 at the end thereof distal of the yoke 42. The pressure roller 26 is journaled on the yoke 42, and includes an axle assembly 50 which extends through the slot 38. The roller 26, yoke 42 and rod 40 can thus be pulled to the left as viewed in FIGS. 3 and 4 thereby causing the spring 46 to compress and urge the assembly back toward the right, as viewed in FIGS. 3 and 4. As seen in FIG. 4, the outer circumferential surface of the roller 26 is grooved as at 52 so as to compliment the ribbed inner surface of the drive belt 2.

As noted in FIG. 1, when the assembly 22 is mounted on the truss bolts 24 and 25, the roller 26 can be pulled to the left so that it will compress the spring 46 and thus wedge the roller 26 against the handrail 14 as the latter moves up the curved path defined by the support roller bow 16. The roller 26 is thus forced against the moving drive belt 2 to in turn press the driVe belt 2 against the handrail 14. The roller 26 also increases the tension on the portion of the drive belt 2 disposed between the roller 26 and the roller 6, thereby increasing the pressure exerted by that section of the drive belt 2 on the handrail 14.

It will be readily appreciated that the tensioning assembly of this invention is of simple yet rugged design, and can be attached to existing people movers in the field. The assembly will directly press the handrail drive belt against the handrail, and will also create an additional degree of tension in the portion of the drive belt interposed between the pressure roller and the downstream drive belt tension roller. The result of adding the tensioning assembly of this invention is increased drive belt life.

Since many changes and variations of the disclosed embodiment of the invention may be made without departing from the inventive concept, it is not intended to limit the invention otherwise than as required by the appended claims.

What is claimed is:

1. In combination with an escalator or moving walkway, a drive assembly for a moving handrail, said drive assembly comprising:

a) an endless drive belt engaging one surface of said handrail, said drive belt being reeved about a power roller and a spaced tension roller spaced apart from said power roller, said power roller and tension roller being operable to impart a loop configuration to said drive belt;

b) a support roller bow assembly engaging the surface of said handbelt opposite said one surface thereof, said roller bow assembly being operable to urge said handrail against said drive belt to provide said handrail with a curved path of travel between said power roller and said tension roller; and c) an auxiliary tension roller assembly mounted inside of said drive belt loop, said auxiliary tension roller assembly including an auxiliary tension roller which is positioned within said drive belt loop closer to one of said power roller and said tension roller than the other, and said auxiliary tension roller assembly further including means for urging said auxiliary tension roller against said drive belt to provide enhanced tensioning of said drive belt.

2. The handrail drive assembly of claim 1 wherein said auxiliary tension roller assembly comprises a bracket mounted on a truss portion of the escalator or moving walkway, said bracket being disposed inside of said drive belt loop and carrying said auxiliary tension roller, and wherein said means for urging comprises a spring mounted on said bracket and operably connected to said auxiliary tension roller.

3. The handrail drive assembly of claim 2 wherein said auxiliary tension roller is mounted on a rod slidably carried on said bracket, and said spring is also mounted on said rod to bias the latter relative to said bracket.

4. The handrail drive assembly of claim 3 wherein said rod is biased along an imaginary line which intersects said power roller and said tension roller.

5. The handrail drive assembly of claim 1 wherein said auxiliary tension roller includes a plurality of circumferential grooves thereon operable to provide increased frictional forces between said auxiliary tension roller and said drive belt.

6. An auxiliary handrail belt drive tensioning assembly for use in conjunction with a belt drive for a moving handrail on an escalator or moving walkway, said tensioning assembly comprising:

a) a bracket adapted to be mounted on a truss of the escalator or moving walkway, said bracket including a pair of spaced apertures operable to receive mounting bolts on the truss; an elongated slot; and a guide;

b) a rod mounted on said bracket, said rod being slidably disposed in said guide;

c) a tension roller mounted on one end of said rod, said tension roller being journaled about an axle which is slidably disposed in said elongated slot whereby said roller axle can move reciprocally with respect to said bracket; and d) spring means mounted on said rod distal of said tension roller, said spring means engaging said guide and being operable to bias said rod and said tension roller in the direction of elongation of said rod.

7. The tensioning assembly of claim 6 wherein said tension roller is mounted in a yoke secured to said one end of said rod.

8. The tensioning assembly of claim 7 wherein said tension roller is provided with a plurality of friction-heightening circumferential grooves thereon.

* * * * *